US005388958A

United States Patent [19]

Dinh

[11] Patent Number: 5,388,958

[45] Date of Patent: Feb. 14, 1995

[54] BLADELESS IMPELLER AND IMPELLER HAVING INTERNAL HEAT TRANSFER MECHANISM

[75] Inventor: Khanh Dinh, Gainsville, Fla.

[73] Assignee: Heat Pipe Technology, Inc., Alachua, Fla.

[21] Appl. No.: 118,103

[22] Filed: Sep. 7, 1993

[51] Int. Cl.[6] ..... F01D 1/36

[52] U.S. Cl. ..... 415/90; 415/53.1; 415/180

[58] Field of Search ..... 415/90, 178, 180, 53.1; 416/96 R, 235

[56] References Cited

U.S. PATENT DOCUMENTS

| | | | |
|---|---|---|---|
| 1,739,137 | 12/1929 | Gay | 310/54 |
| 2,327,786 | 8/1943 | Heintz | 310/54 |
| 2,632,598 | 3/1953 | Wales, Jr. | 415/90 |
| 3,017,848 | 1/1962 | Bishop | 415/90 X |
| 3,094,273 | 6/1963 | Hull et al. | 415/180 |
| 3,275,223 | 9/1966 | Fowell | 415/90 |
| 3,842,596 | 10/1974 | Gray | 416/96 X |
| 3,866,668 | 2/1975 | Doerner | 415/90 |
| 3,914,630 | 10/1975 | Lloyd et al. | 310/64 |
| 4,036,584 | 7/1977 | Glass | 415/90 |
| 4,137,472 | 1/1979 | Workman | 310/61 |
| 4,240,000 | 12/1980 | Harano et al. | 310/54 |
| 4,322,646 | 3/1982 | Persson | 310/64 |
| 4,406,959 | 9/1983 | Harano et al. | 310/61 |
| 4,705,453 | 11/1987 | Hopfensperger | 415/53.1 |
| 4,712,976 | 12/1987 | Hopfensperger et al. | 415/53.1 |
| 4,869,644 | 9/1989 | Takigawa | 416/235 |
| 5,073,736 | 12/1991 | Gschwender | 310/88 |
| 5,192,183 | 3/1993 | Wilkinson | 415/90 X |
| 5,209,644 | 5/1993 | Dorman | 416/235 |
| 5,240,371 | 8/1993 | Belomestnov | 415/53.1 |
| 5,283,488 | 2/1994 | Ponnappan et al. | 310/54 |

FOREIGN PATENT DOCUMENTS

| | | | |
|---|---|---|---|
| 452393 | 9/1913 | France | 415/90 |
| 63549 | 5/1980 | Japan | 310/64 |
| 109796 | 8/1980 | Japan | 415/90 X |
| 199524 | 2/1993 | Taiwan, Prov. of China | 415/90 X |
| 985444 | 12/1982 | U.S.S.R. | 415/90 |

*Primary Examiner*—John T. Kwon
*Assistant Examiner*—Michael Lee
*Attorney, Agent, or Firm*—Nilles & Nilles

[57] ABSTRACT

An impeller displaces fluids without turbulence, thereby reducing noise and increasing efficiency. The impeller employs annular disks stacked on a shaft which may be rotatably mounted in a specially shaped housing. The disks cooperate with a complementary surface formed, e.g., by the interior of the impeller housing or by another impeller, so as to use a combination of surface friction, centrifugal forces, and a venturi effect to propel fluids tangentially without turbulence. The impeller is well suited for use with a heat exchange device because the flat disks present a large surface area providing good heat exchange with fluids flowing past the disks. A heat pipe or other suitable heat transfer mechanism may be provided in the shaft of the impeller to form a heat transfer system integral with the impeller for heating or cooling purposes.

16 Claims, 4 Drawing Sheets

BLADELESS IMPELLER AND IMPELLER HAVING INTERNAL HEAT TRANSFER MECHANISM

BACKGROUND OF THE INVENTION

1. Field of the Invention

The invention relates to impellers and, more particularly, relates to noiseless impellers and to noiseless impellers having internal heat transfer mechanisms.

2. Discussion of the Related Art

Impellets are well known for displacing fluids in either a gaseous or liquid form. The most common impellers for displacing gaseous fluids are fans and blowers illustrated in FIGS. 1 and 2, respectively.

Referring to FIG. 1, the typical fan 10 includes a plurality of curved blades 12 mounted on a shaft 14 extending through a circular opening 16 formed in a housing 18 and rotatably mounted in the housing. Upon rotation of the shaft 14, the curved blades 12 draw air or another gas through the housing 18.

Referring to FIG. 2, the typical blower 20 includes a turbine 22 rotatably mounted in a cylindrical housing 24. The turbine 22 draws air or another gas into the housing 24 via apertures formed in the ends 26, and discharges the gas through an outlet 28.

Both the blades of fans and the turbines of blowers operate by colliding with the fluid being displaced and by pushing the fluid to displace it. This type of operation creates turbulence which not only creates unpleasant noise, but which also impedes the movement of the fluid and reduces the overall efficiency of the device.

Impellers of the type described above are often used to force air or another fluid through heating, cooling, heat transfer, or heat dissipation systems. Such systems typically employ heat pipes and/or other heat transfer mechanisms in combination with a separate blower or fan. The use of a separate impeller and heat transfer mechanism necessarily results in a relatively large and complex system which is difficult to install and to service and which is poorly suited for applications in which heat transfer mechanisms must be mounted in small spaces.

OBJECTS AND SUMMARY OF THE INVENTION

It is therefore an object of the invention to provide an impeller which is highly efficient and essentially noiseless.

In accordance with one aspect of the invention, this object is achieved by providing an impeller including a rotor and an element presenting a complementary surface. The rotor includes a rotatable shaft and a plurality of flat annular disks fixedly mounted on the shaft. The disks are preferably spaced along the shaft with gaps formed therebetween. In use, a pressure drop occurs in a gap presented by the complementary surface upon rotation of the rotor to propel fluids without turbulence.

Preferably, the complementary surface is formed on a housing which forms a volute which includes a transverse inlet, a transverse, a suction zone positioned adjacent the inlet, a discharge zone positioned adjacent the outlet, and an intermediate zone positioned between the suction and discharge zones and presenting the complementary surface. In a highly preferred configuration, the suction zone decreases in diameter from the inlet towards the intermediate zone, and the discharge zone increases in diameter from the intermediate zone towards the outlet.

Another object of the invention is to quietly and efficiently displace fluids without turbulence.

In accordance with another aspect of the invention, this object is achieved by rotating a rotor which draws the fluid between the rotor and a complementary surface located adjacent the rotor using a combination of frictional forces, venturi effect, and centrifugal forces.

Preferably, the rotor comprises a plurality of flat annular disks fixedly mounted on a shaft and spaced axially along the shaft with gaps formed therebetween, and the drawing step comprises 1) drawing the fluid into an inlet of a housing via suction forces present in a suction zone of the housing located adjacent the inlet, 2) centrifugally accelerating the fluid, by applying frictional forces to the fluid by rotating the disks, into a narrow intermediate zone of the housing which forms the complementary surface, 3) accelerating the fluid through the intermediate zone of the housing, creating the suction forces in the suction zone, 4) conveying the fluid through a discharge zone located downstream of the intermediate zone, and then 5) tangentially discharging the fluid from the housing.

Yet another object of the invention is to provide a heat transfer system which is compact and easy to install because the heat transfer mechanism is formed integral with the associated impeller.

In accordance with another aspect of the invention, this object is achieved by providing a heat transfer mechanism including an impeller having a rotary shaft having first and second portions for thermal communication with a relatively warm environment and a relatively cool environment, respectively, and a heat transfer mechanism, provided on the shaft, for transferring heat from the relatively warm environment to the relatively cool environment. Preferably, the shaft is hollow, and the heat transfer mechanism comprises a heat pipe provided in the hollow shaft. The heat pipe comprises an evaporator portion for thermal communication with the relatively warm environment, and a condenser portion for thermal communication with the relatively cool environment.

The heat transfer system may be used in all heat transfer applications and to heat and/or cool a unit, in which case the impeller comprises first and second impeller sections provided in first and second housing sections, respectively. The first impeller section includes a portion of the shaft containing the evaporator portion of the heat pipe, and the second impeller section includes a portion of the shaft containing the condenser portion of the heat pipe.

Other objects, features, and advantages of the present invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications within the scope of the present invention may be made without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent-like parts throughout, and in which.

DETAILED DESCRIPTION OF THE PREFERRED EMBODIMENTS

Resume

Pursuant to the invention, an impeller is provided which displaces fluids without turbulence, thereby reducing noise and increasing efficiency. The impeller employs annular disks stacked on a shaft which may be rotatably mounted in a specially shaped housing. The disks and a complementary surface cooperate so as to use a combination of surface friction, centrifugal forces, and a pressure drop effect to propel fluids without turbulence. The impeller is well suited for use with a heat exchange device because the flat disks present a large surface area providing good heat exchange with fluids constantly flowing past the disks. A heat pipe or other suitable heat transfer mechanism may be provided in the shaft of the impeller to form a heat transfer system integral with the impeller for heating or cooling purposes.

STRUCTURE AND OPERATION OF BLADELESS IMPELLER

Figure 3:
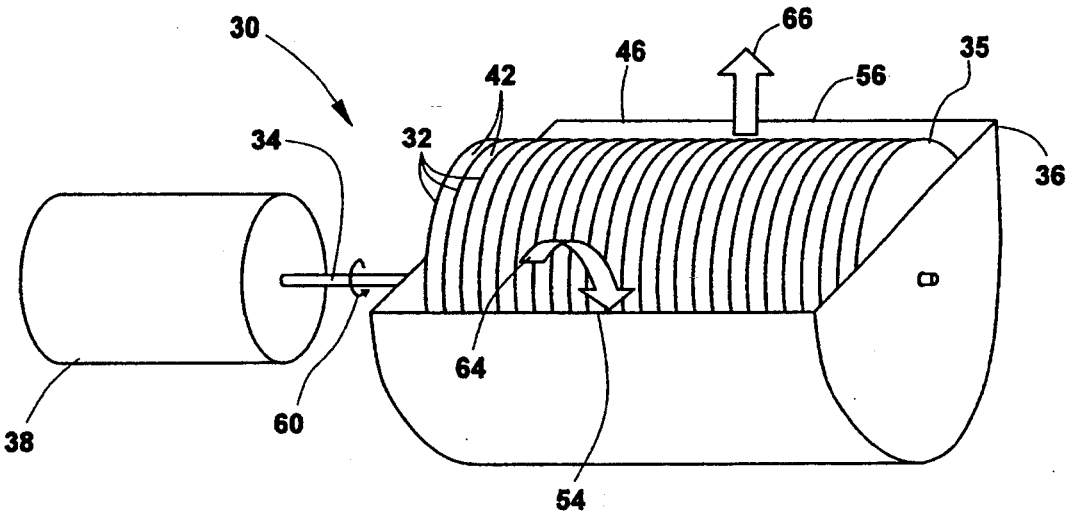
FIG. 3 is a perspective view of a bladeless impeller constructed in accordance with the preferred embodiment of the present invention.
Figure 4:
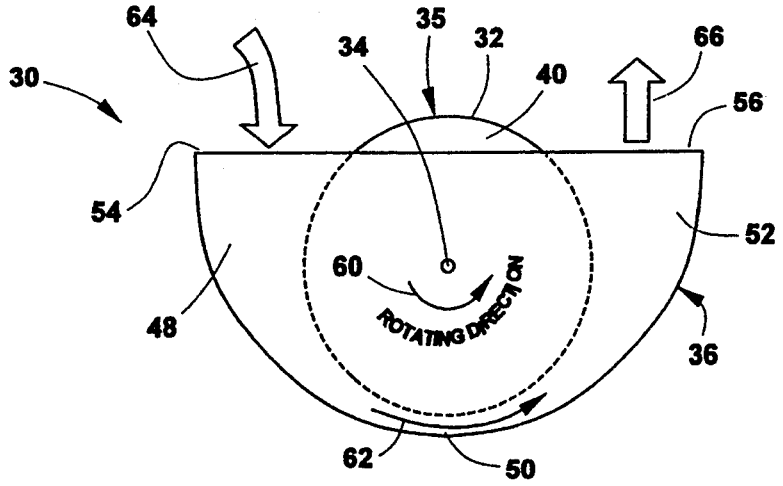
FIG. 4 is an end view of the bladeless impeller of FIG. 3.

Referring now to FIGS. 3 and 4, a bladeless impeller 30 constructed in accordance with a preferred embodiment of the invention includes a rotor 35 mounted in a housing 36 and driven by a motor 38. Impeller 30 could be used to displace any liquid or gaseous fluid, but is particularly well adapted to displace air or a similar gas.

Rotor 35 includes a plurality of thin, flat annular disks 32 spaced axially along a shaft 34 and fixedly mounted on the shaft. "Fixedly" as used herein does not require that the disks 32 be nondetachably or even immovably connected to the shaft, but only that the disks rotate with the shaft. Shaft 34 is rotatably mounted in housing 36 and has a distal end which extends through the housing and is coupled to the motor 38.

The disks 32 are very thin and have adjacent flat surfaces 40 defining gaps 42 therebetween. Disks 32 could be constructed from any suitable material and, if used in a heat transfer system of the type described below, should be made of aluminum or another suitable material having a high coefficient of thermal transfer. The diameter of the disks 32, as well as the thickness of the gaps 42, should be dimensioned so as to maximize performance of the impeller 30 without creating turbulence. Disks 32 could also be roughened or formed from a high-friction material to increase surface friction between the disks and the fluid being displaced by the impeller or to increase heat transfer if used as a heat pipe heat transfer device.

Figure 1:
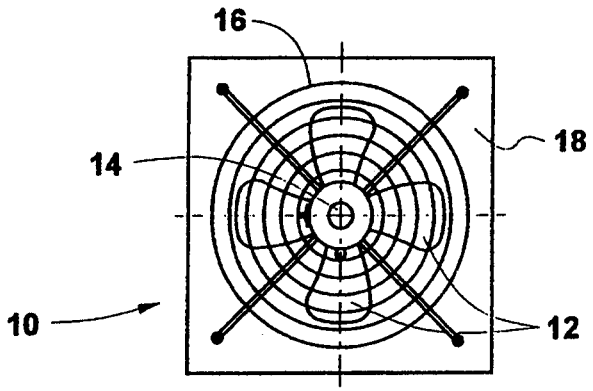
FIG. 1 (PRIOR ART)
FIG. 1 is a front elevation view of a prior art fan, appropriately labelled "PRIOR ART"
Figure 2:
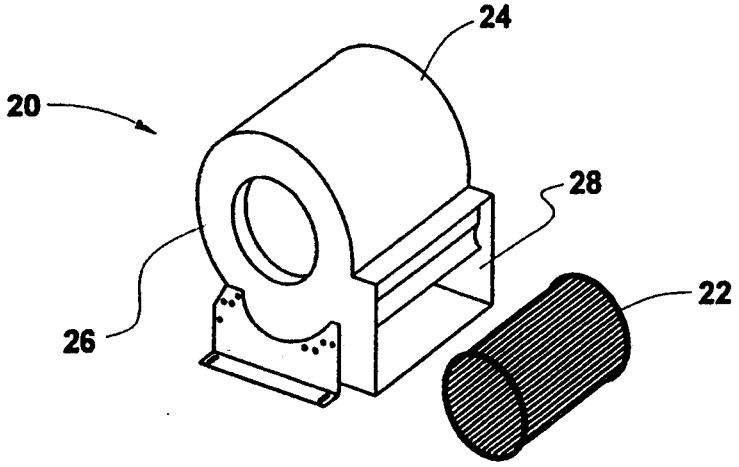
FIG. 2 (PRIOR ART)
FIG. 2 is a partially exploded perspective view of a prior art blower, appropriately labelled "PRIOR ART"

Housing 36, though generally semi-cylindrical, is specially shaped and oriented with respect to the rotor 35 so as to form a volute defining consecutive zones 48, 50, and 52 between the edges of the disks 32 and the inner periphery 46 of the housing 36. Zone 48 constitutes a suction zone extending from an inlet 54 of the housing 36 to the second zone 50 and decreasing in diameter from the inlet 54 towards the zone 50. Zone 48 is subject to sub-ambient pressures during operation of the impeller 30 for reasons discussed below and thus draws fluid into the impeller. Intermediate zone 50 is narrower than either of zones 48 and 52 and presents a complementary surface defining a gap which in use forms the throat of a venturi-like element causing a pressure drop and creating the suction in zone 48. As clearly illustrated in FIGS. 1, 3, and 4, the relatively narrow gap extends less than the full length of the volute and, because the axes generally along a plane which is a perpendicular to the page in FIG. 4. Discharge zone 52 presents a surface of the rotor 35 and housing 36 are offset, the gap has a minimum thickness extending area which increases fairly rapidly from zone 50 to an outlet 56 of the housing 36. This increasing surface area facilitates non-turbulent fluid flow out of the housing 36 during operation of the impeller 30.

Motor 38 may be any device capable of directly or indirectly imparting rotational motion to shaft 34. In the illustrated embodiment, motor 38 has a rotary output element directly coupled to shaft 34.

The operation of impeller 30 will now be described, displacing air as an exemplary fluid. Operation of the impeller is initiated by energizing the motor 38 to rotate the shaft 34 in the direction of arrows 60, thus rotating the disks 32 within the housing 36. Surface friction between the side surfaces 40 of the disks and the air entrain the air to move with the disks 42 radially from the inlet of the volute, i.e., in the direction of arrow 64 in FIGS. 3 and 4. The annular disks 32 centrifugally accelerate the air in a curved trajectory so that it is projected to the perimeter of the disks 32 as it moves through suction zone 48 and into the narrowed area 50 forming the throat of the venturi to form a stream 62. There, the velocity of the air increases and causes a pressure drop, creating sub-ambient or sub-atmospheric pressure in zone 48 that draws more air into the inlet 54 of housing 36 as represented by the arrow 64. The air then exits the intermediate zone 50 and flows tangentially through the discharge zone 52 and radially out of the outlet 56 of the housing 36 in the direction of arrow 66 without turbulence. This lack of turbulence results in essentially noiseless operation of the impeller 30 which not only is acoustically pleasing but which also increases the overall efficiency of the system.

The impeller 30 need not be encased in the specially designed housing 36 and, in fact, need not be encased in a housing at all so long as it is positioned adjacent an element presenting a complementary surface to the disks to define a space in which a pressure drop occurs upon operation of the impeller. Thus, the impeller 30 could be positioned adjacent an electronic chip or the like with the surface of the chip presenting the required complementary surface. Air propelled by the impeller would cool the surface of the chip as it is drawn over the chip by the impeller.

The required complementary surface for an impeller could also be formed by the disks of a second impeller extending parallel to the impeller. Thus, referring to FIG. 5, the impeller 30 could be mounted in a housing 70 in parallel with a second impeller 30' with a space 72 formed therebetween. The second impeller 30' is identical to impeller 30 and includes a rotor 35' formed from a plurality of stacked disks 32' mounted on a shaft 34' driven by an electric motor 38'.

Figure 5:
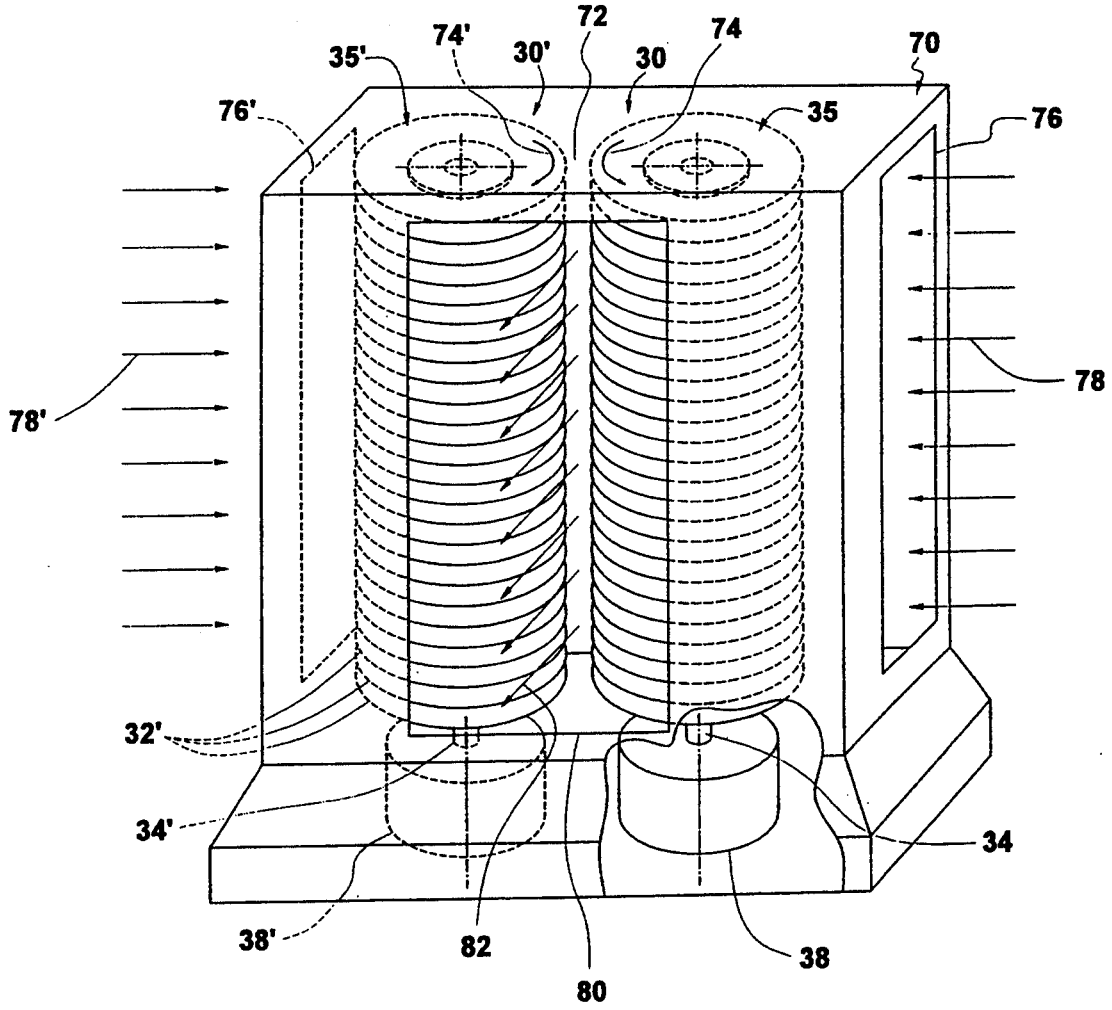
FIG. 5 is a side elevation view of a blower employing a pair of bladeless impellers acting in concert.

In operation, the rotors 35, 35' of impellers 30, 30' are driven to rotate in opposite directions by the motors 38, 38' as represented by the arrows 74, 74' in FIG. 5. The rotating impellers 30, 30' draw air into opposed radial inlets 76, 76' of the housing 70 as represented by the arrows 78, 78', through the gap 72 causing a pressure drop, and out of a common transverse outlet 80 of housing 70 in the direction of arrows 82. Airflow through the gap 72 and out of the enlarged outlet 80 of the housing 70 is non-turbulent despite the fact that housing 70 is rectangular rather than generally semi-cylindrical.

Because the bladeless impeller thus far described incorporates an elongated shaft having a relatively high surface area which to one extent or another is in thermal communication with the fluid being displaced and because the rotor incorporating flat disks is itself well suited for heat transfer, it has been discovered that such an impeller is well suited for receiving an internal heat transfer mechanism. A possible configuration of such an internal heat transfer mechanism and two applications of such a mechanism will now be described.

DESCRIPTION AND OPERATION OF HEAT TRANSFER SYSTEM FORMED FROM AN IMPELLER HAVING AN INTERNAL HEAT TRANSFER MECHANISM

Figure 6:
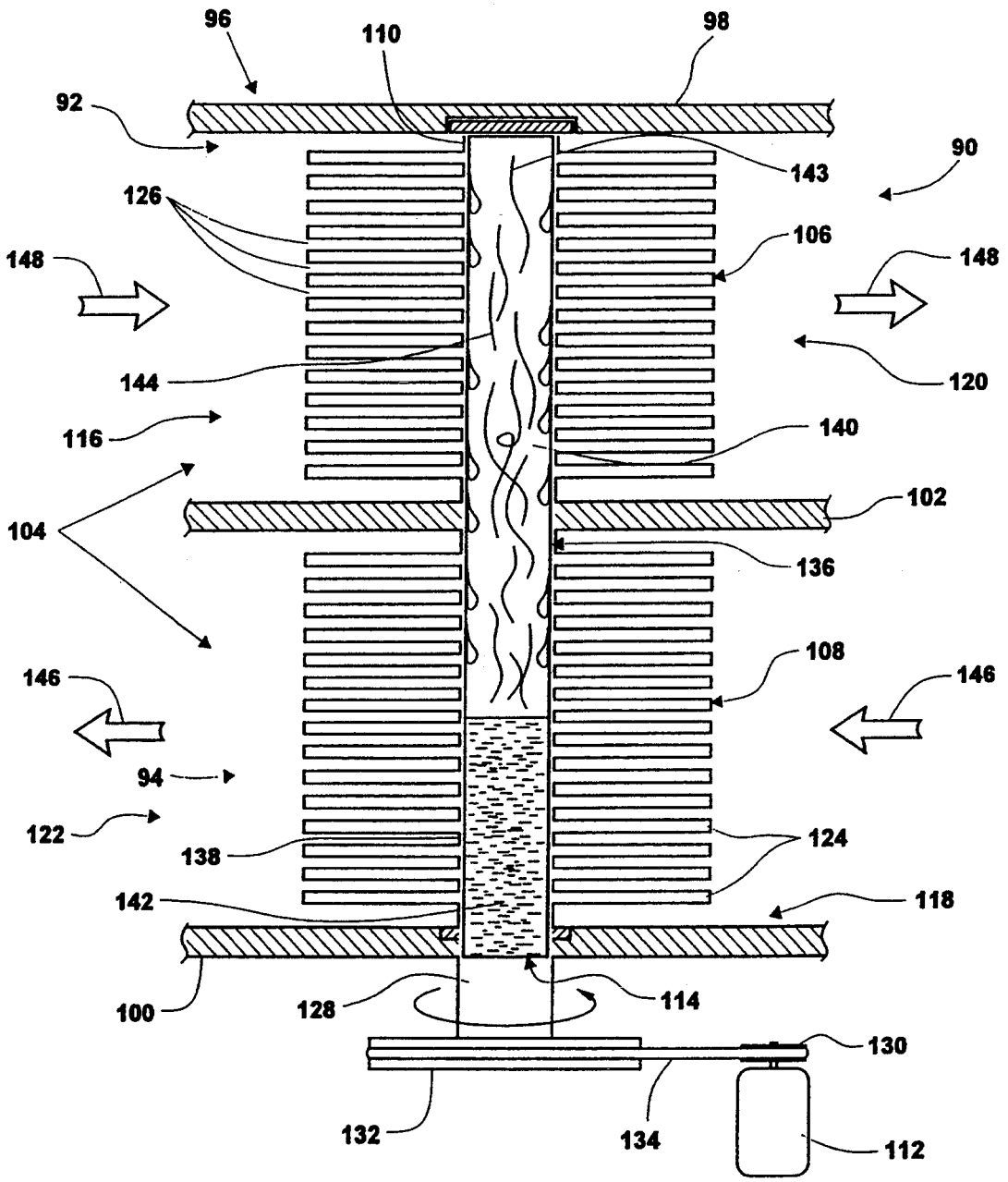
FIG. 6 is a schematic sectional elevation view of a heat transfer system incorporating a bladeless impeller employing the principles of the impeller illustrated in FIGS. 3 and 4 and having an internal heat pipe.

Referring now to FIG. 6, a heat transfer system 90 includes a heating portion 94 which is heated by and cools the ambient environment and a cooling portion 92 which is cooled by and heats the ambient environment stacked one on top of the other in a housing 96 having upper and lower walls 98 and 100 separated by a central partition 102. A rotor 104 is mounted in the housing 96 to form upper and lower impeller sections 106 and 108 disposed in the respective sections 92 and 94 of the heat transfer system 90. Sections 106 and 108 include a common vertical or inclined shaft 110 driven by a motor 112 and having an internal heat transfer mechanism 114.

The housing 96 could take any of a variety of shapes so long as it provides the required complementary surfaces for impeller sections 106 and 108. In the illustrated embodiment, the impeller formed from impeller sections 106 and 108 preferably takes the form of a bladeless impeller of the type described in the preceding section. The orientations of the housings of the impeller sections 106 and 108 accordingly are reversed, and the housings present volutes having respective inlet or suction zones 116 and 118 and outlet or discharge zones 120 and 122 of the type described above, and also having central zones (not shown) in which pressure drops occur. The common transverse flow rotor 104 of the impeller sections 106 and 108 comprises a plurality of thin, flat disks 124 stacked on top of one another with gaps 126 formed therebetween and fixedly mounted on the shaft 110. Shaft 110 is rotatably mounted on or through the upper and lower walls 98 and 100 of housing 96 and has a free end 128 depending from the housing 96 and driven by motor 112 either directly, or indirectly by pulleys 130 and 132 and a belt 134.

Heat transfer mechanism 114 could be any of a number of devices, but preferably comprises a heat pipe, which is ideally suited for mounting in an elongated shaft. The heat pipe forming mechanism 114 is, per se, well known and may comprise a tubular insert or hollow interior 136 formed in shaft 110 as illustrated. Heat pipe 114 has an evaporator or cooling portion 138 and a condenser or heating portion 140. As is known in the art, heating of the evaporator portion 138 by thermal contact with relatively warm fluid vaporizes the liquid refrigerant 142 disposed therein to form vaporized refrigerant 143 while cooling the fluid. Vaporized refrigerant 143 rises into the condenser portion 140 of heat pipe 114, where it is cooled by transferring heat to the relatively cool fluid flowing through the upper portion 92 of the system 90 and condenses on the surface of the insert or hollow interior 136 of shaft 110. Heat transfer can be increased by providing an internal wick or grooves 144 on the internal wall of the heat pipe.

In operation, warm air flows into the lower portion 94 of the heat transfer system 90 in the direction of arrows 146, is drawn through the portion 94 by the lower impeller section 108, and is cooled by vaporizing refrigerant 142 in the evaporator portion 138 of heat pipe 114. Vaporized refrigerant 143 rises into the condenser portion 140 of heat pipe 114, where it is cooled by air or another fluid being drawn through the upper portion 92 of system 90 in the direction of arrows 148 by the upper impeller section 106, thus warming the air or other fluid and condensing the refrigerant. The condensed refrigerant 142 runs down the surface of the interior 136 of shaft 110 and into the evaporator portion 138 of heat pipe 114, where the process is repeated. The shaft/heat pipe also works well in a horizontal position. In this case, any of the positions 106 or 108 can be in the warm air flow.

It can thus be seen that the heat transfer system 90 having an impeller incorporating an internal heat transfer mechanism 114 is remarkably simple and compact because fluid displacement and fluid cooling and/or heating are performed by the same structure.

Many changes and modifications could be made to the present invention without departing from the spirit and scope thereof. For instance, the disclosed bladeless impeller could take any number of forms, so long as it does not use conventional blades or turbines, or at least uses such blades or turbines only to supplement the disks, and results in non-turbulent or essentially non-turbulent and tangentially discharged fluid flow through the impeller.

Moreover, impellers having internal heat transfer devices such as the illustrated heat pipe are not limited to the applications described, but could be used in virtually any heat transfer system. Such impellers are also not limited to bladeless impellers of the type described above, but only need incorporate a rotating vertical, inclined or horizontal shaft which supports disks, blades, turbines, or other means for drawing air through the impeller.

I claim:

1. An impeller comprising:

(A) a transverse flow rotor which includes (1) a rotatable shaft, and (2) a plurality of flat annular disks which are fixedly mounted on said shaft and which entrain fluid by friction upon rotation of said shaft and propel the fluid generally transversely through said rotor; and (B) a volute which on cases said rotor and which has a radial inlet and a radial outlet, wherein said volute present a gap which is formed adjacent an outer radial surface of said rotor, said gap (1) extending less than the full circumferential length of said volute, (2) having a radial distance which is less than the radial distances between the rotor and the remainder of said volute, and (3) having a minimum width occurring generally along a single axial plane of said volute, and wherein, when said shaft is rotated fluid flow through said gap forms a sub-ambient pressure zone the reduced fluid pressure of which draws fluid generally towards said gap, thereby enhancing operation of said rotor.

2. An impeller as defined in claim 1, wherein said volute further presents (1) a suction zone positioned adjacent said inlet, (2) a discharge zone positioned adjacent said outlet, and (3) an intermediate zone positioned between said suction and discharge zones and in which is located said gap.

3. An impeller as defined in claim 2, wherein (1) said suction zone decreases in diameter from said inlet towards said intermediate zone, and (2) said discharge zone increases in diameter from said intermediate zone towards said outlet.

4. An impeller as defined in claim 1, wherein said disks are formed from a high friction material.

5. A method of displacing a fluid comprising:

propelling said fluid generally transversely without turbulence through a volute of an impeller by rotating a flat disk rotor to draw said fluid into a radial inlet of said impeller, through a gap, and out of a radial outlet of said impeller, said gap (1) being formed adjacent an outer radial surface of said rotor, (2) extending lens than the fill circumferential length of said volute, (3) having a radial distance which is less than the radial distances between the rotor and the remainder of said volute, and (4) having a minimum width occurring generally along a single axial plane of said volute, said propelling step using a combination of frictional forces produced by friction between flat disks of said rotor and said fluid, a pressure drop produced by fluid flow through said gap, and centrifugal forces produced by rotation of said disks.

6. A method as defined in claim 5, wherein (1) said rotor comprises a plurality of flat annular disks fixedly mounted on a shaft and spaced axially along said shaft with gaps formed therebetween, and wherein (2) said drawing step comprises (a) drawing said fluid into said inlet via suction forces present in a, suction zone of said volute located adjacent said inlet, (b) centrifugally accelerating said fluid, by applying frictional forces to said fluid by rotating said disks, into said gap (c) accelerating said fluid through said gap, thereby creating said suction forces in said suction zone, (d) propelling said fluid through a discharge zone located downstream of said gap, and then (e) tangentially discharging said fluid from said volute.

7. A method as defined in claim 6, further comprising enhancing surface friction between said disks and said fluid.

8. A method as defined in claim 7, wherein said enhancing step comprises providing disks with roughened surfaces.

9. A method as defined in claim 5, wherein said fluid comprises a gas.

10. A method as defined in claim 5, wherein said fluid comprises a liquid.

11. A heat transfer system comprising:

(A) a transverse flow impeller having a hollow rotary shaft having first and second portions for thermal communication with a relatively warm environment and a relatively cool environment, respectively; and (B) a heat pipe, provided in said shaft, for transferring heat from said relatively warm environment to said relatively cool environment, said heat pipe including (1) an evaporator portion for thermal communication with said relatively warm environment, and (2) a condenser portion for thermal communication with said relatively cool environment, wherein (a) said impeller includes first and second impeller sections including first and second volutes, respectively, (b) said first Impeller section includes (i) a first portion of said shaft containing said evaporator portion of said heat pipe and (ii) a first transverse flow rotor portion formed from a plurality of stacked flat disks mounted on said first portion of said shafts, (c) said second impeller section includes (i) a second portion of said shaft containing said condenser portion of said heat pipe and (ii) a second transverse flow rotor portion formed from plurality of stacked flat disks mounted on said second potion of said shaft, and (d) the orientations of said first and second volutes are reversed such that the direction of fluid flow through said first rotor portion is opposite to direction of fluid flow through said second rotor portion.

12. A heat transfer system as defined in claim 11, wherein each of said first and second volutes presents a gap which is formed adjacent an outer radial surface of the respective rotor, said gap (1) extending less than the full circumferential length of said volute, (2) having a radial distance which is less than the radial distances between the rotor and the remainder of said volute, and (3) having a minimum width occurring generally along a single axial plane of said volute.

13. A heat transfer system as defined in claim 12, wherein each of said volute includes (1) a radial inlet, (2) a radial outlet, (3) a suction zone positioned adjacent said inlet, (4) a discharge zone positioned adjacent said outlet, and (5) an intermediate zone which is positioned between said suction and discharge zones and in which is formed said gap.

14. An impeller comprising:

(A) a transverse flow rotor which includes (1) a rotatable shaft, (2) a plurality of flat annular disks which are fixedly mourned on said shaft and which entrain fluid by friction upon rotation of said shaft and propel the fluid generally transversely through said rotor, and (3) means, provided on each of said disks, for enhancing surface friction between said disks and fluid being displaced by said disks; and (B) a volute which encases said rotor and which has a radial inlet and a radial outlet, wherein said volute presents a gap which is formed adjacent an outer radial surface of the respective rotor, said gap (1) extending less than the full circumferential length of said volute, (2) having a radial distance which is less than the radial distances between the rotor and the remainder of said volute, and (3) having a minimum width occurring generally along a single axial plane of said volute.

15. An impeller as defined in claim 14, wherein said means for enhancing comprises a roughened surface of said disks.

16. An impeller comprising:

(A) a first transverse flow rotor which includes (1) a first rotatable shaft, and (2) a plurality of flat annular disks which arc fixedly mounted on said first shaft and which entrain fluid by friction upon rotation of said shaft and propel the fluid generally transversely through said first rotor from a radial inlet of said impeller and out of a radial outlet of said impeller; and (B) a second transverse flow rotor which is positioned adjacent to and parallel to said first rotor and which includes (3) a second shaft rotatable in a direction counter to that of said first shaft, and (4) a plurality of fiat annular disks which are fixedly mounted on said second shaft and which entrain fluid by friction upon rotation of said second shaft and propel the fluid generally transversely through said second rotor from a second radial inlet of said impeller and out of said radial outlet.

* * * * *

UNITED STATES PATENT AND TRADEMARK OFFICE

CERTIFICATE OF CORRECTION

PATENT NO. : 5,388,958

DATED : February 14, 1995

INVENTOR(S) : Dinh

It is certified that error appears in the above-indentified patent and that said Letters Patent is hereby corrected as shown below:

Col. 1, line 13, delete "Impellets" and substitute -- Impellers --;
line 62, after "transverse" insert --outlet --;

Col. 4, line 20, after "axes" insert -- of the rotor 35 and housing 36 are offset, the gap has a minimum thickness extending --;

Col. 6, line 67, delete "on cases" and substitute -- encases --;

Col. 7, line 1, delete "present" and substitute -- presents --;
line 10, after "rotated" insert a comma;
line 37, delete "lens" and substitute -- less --;
line 37, delete "fill" and substitute -- full --;
line 56, after "a" delete the comma;

UNITED STATES PATENT AND TRADEMARK OFFICE

CERTIFICATE OF CORRECTION

PATENT NO. : 5,388,958 Page 2 of 2

DATED : February 14, 1995

INVENTOR(S) : Dinh

It is certified that error appears in the above-indentified patent and that said Letters Patent is hereby corrected as shown below:

Col. 8, line 28, delete "Impeller" and substitute -- impeller --;
line 33, delete "shafts" and substitute -- shaft --;
line 38, after "from" insert -- a --;
line 43, after "to" insert -- the --;

Col. 9, line 2, delete "mourned" and substitute -- mounted --;

Col. 10, line 4, delete "arc" and substitute -- are --;
line 16, delete "fiat" and substitute -- flat --.

Signed and Sealed this

Tenth Day of October, 1995

*Attest:*

Bruce Lehman

BRUCE LEHMAN

*Attesting Officer*

*Commissioner of Patents and Trademarks*